US009378718B1

(12) United States Patent
Trebard

(10) Patent No.: US 9,378,718 B1
(45) Date of Patent: Jun. 28, 2016

(54) METHODS AND SYSTEM FOR COMPOSING

(71) Applicant: Sven Gustaf Trebard, Stockholm (SE)

(72) Inventor: Sven Gustaf Trebard, Stockholm (SE)

(73) Assignee: Sven Trebard, Stockholm (SE)

( * ) Notice: Subject to any disclaimer, the term of this patent is extended or adjusted under 35 U.S.C. 154(b) by 0 days.

(21) Appl. No.: 14/562,834

(22) Filed: Dec. 8, 2014

(51) Int. Cl.
*G10H 1/26* (2006.01)
*G10H 1/00* (2006.01)
*G10H 7/00* (2006.01)

(52) U.S. Cl.
CPC ..... *G10H 1/26* (2013.01); *G10H 1/0025* (2013.01); *G10H 7/002* (2013.01); *G10H 2220/121* (2013.01); *G10H 2240/031* (2013.01); *G10H 2250/005* (2013.01); *G10H 2250/131* (2013.01)

(58) Field of Classification Search
CPC ..... G10H 1/26
USPC ..... 84/609, 615
See application file for complete search history.

(56) References Cited

U.S. PATENT DOCUMENTS 7,750,224 B1 * 7/2010 Rav-Niv ..... G09B 15/00 84/483.1
7,858,867 B2 * 12/2010 Sherwani ..... G10H 1/0025 84/609
8,487,176 B1 * 7/2013 Wieder ..... G10H 1/0025 84/615
8,680,387 B2 * 3/2014 Gannon ..... G10H 1/0025 84/613
2007/0044643 A1 * 3/2007 Huffman ..... G10H 1/46 84/625
2007/0227342 A1 * 10/2007 Ide ..... G10H 1/0058 84/645
2009/0133567 A1 * 5/2009 Okano ..... G10H 1/0066 84/609
2010/0199833 A1 * 8/2010 McNaboe ..... G10H 1/0025 84/625
2010/0305732 A1 * 12/2010 Serletic ..... G06F 3/0481 700/94
2011/0011243 A1 * 1/2011 Homburg ..... G10H 1/0066 84/612
2011/0011246 A1 * 1/2011 Buskies ..... G10H 1/0066 84/613
2011/0175915 A1 * 7/2011 Gehring ..... G10H 7/008 345/440
2012/0060668 A1 * 3/2012 Lengeling ..... G10H 1/42 84/645
2012/0300950 A1 * 11/2012 Usui ..... G10H 1/0008 381/56
2013/0030559 A1 * 1/2013 Estes ..... G11B 5/027 700/94
2014/0208922 A1 * 7/2014 Adnitt ..... G06F 3/048 84/609
2014/0254834 A1 * 9/2014 Umeo ..... H04R 5/04 381/119
2014/0301573 A1 * 10/2014 Kiely ..... G11B 27/031 381/119
2015/0013528 A1 * 1/2015 Buskies ..... G10H 1/0041 84/611
2015/0309703 A1 * 10/2015 Robertson ..... G10H 1/0025 715/716

OTHER PUBLICATIONS

Logic Pro 9 Users Manual ((https://documentation.apple.com/en/logicpro/usermanual/Logic%20Pro%209%20User%20Manual%20(en).pdf 2009).*

* cited by examiner

*Primary Examiner* — David Warren

(57) ABSTRACT

Methods and system for creating and editing a composition. A composition model encodes the structure and the content of the composition. The composition model also encodes patterns. Patterns may be used for temporarily add content to the composition. The system generates a presentation representative of the composition model.

8 Claims, 18 Drawing Sheets

METHODS AND SYSTEM FOR COMPOSING

CROSS REFERENCE TO RELATED APPLICATION AND CLAIM OF PRIORITY

This application claims priority from U.S. Provisional Patent Application 61/913,610, filed 9 Dec. 2013, and titled Device and methods for composing music.

FIELD OF INVENTION

The present invention relates to technology for computer-based composing.

BACKGROUND

Any creative process may be described as alternating a mutation process and a selection process to continuously produce improved versions.

The selection process determines if a new version is an improvement compared to the current version. An operator generally takes part in the selection process, and makes selections based on good taste. Good taste is generally not possible to automate.

The mutation process may be divided into a modification process and a presentation process. In some creative fields, e.g. painting, the modification and presentation processes are united. In other fields, e.g. computer-based music, they may be separate.

An operator generally takes part in the modification process, by manually creating new, improved versions. The modification process may benefit from automation, e.g. by automatically and randomly mixing composition patterns.

The presentation process may be automated. During the modification process, the operator may define a set of abstract expansion directives, making it possible to make large presentation changes based on small modifications of expansion directives. The presentation of an interpretation of said directives may be automated, and presented to the selection process, e.g. the good taste of the operator.

The selection process, e.g. the operator, evaluates the presentation, accepts or rejects the new version, and encodes new modifications. A new presentation is produced and evaluated. This cycle continues until the operator is satisfied.

In manually created music, chord progressions, which is a known concept in the art, may be used as expansion directives. A presentation process, e.g. an instrumentalist, expands the chord progression into an improvised set of notes. Computer-based composing may provide more powerful directives than chord progressions.

DESCRIPTION OF RELATED ART

Technology to assist musical composing has been developed that provides tools for creation and editing of songs. There are tools that provides automatic mutation, but the editing and selection of the expansion directives are generally limited to determining which set of patterns to use at different temporal locations.

U.S. Pat. No. 7,858,867, entitled Metadata-based song creation and editing, by Sherwani et al, uses a database to associate metadata with musical elements and receives a selection of metadata to produce lists of matching musical elements, from which a subset of musical elements is selected and presented.

U.S. Pat. No. 8,680,387, entitled Systems and method for composing music, by Gannon, uses a database of pre-recorded musical sequences to generate music.

U.S. Pat. No. 8,487,176, entitled Music and sound that varies from one playback to another, by Wieder, uses spawn events to indicate that alternative sequences of music at specific temporal intervals may be used for a variable performance. The alternative sequences are part of the final composition.

The present invention integrates patterns and pattern usage directives into a composition model, with no dependency on data outside the composition model. The present invention does not rely on weights based on the tags and opinions of a community of users. The patterns of the present invention are not associated with specific temporal locations. Thus they cannot be viewed as alternatives to foundation sound sequences, and they cannot overlay foundation sound sequences. The patterns of the present invention are created, edited and generally made redundant as a part of a composing process.

SUMMARY

The preferred embodiment of the invention provides a method for composing or performing music. An operator defines a composition structure and encodes intent as events in a composition model. Some events encodes performance elements, e.g. notes and lyrics. Other events encode notational elements, e.g. chords, key and time signature. Yet other events encode abstract intent, e.g. genre, intensity and complexity. The operator encodes musical patterns in the composition model, using similar structures and events. The patterns may be used for generating temporary events. The generation of temporary events can be identified as an automated mutation process.

Embodiments of the invention produces a presentation based on the structure and the events of the composition model, and presents this presentation to an operator. Events encoding abstract intent may result in a random outcome, which may vary with each new produced presentation.

In one embodiment of the invention, an operator evaluates the produced presentation. This evaluation can be identified as a selection process. The operator modifies the structure and events of the composition model. The invention produces a new presentation, based on the modified composition model, and presents it to the operator. This cycle continues until the operator is satisfied with the end result.

In one embodiment, the produced presentation may be used for real-time performances, where the operator adjusts intent while the composition is generated and presented.

Embodiments of the invention may be used for arts other than music composing.

Embodiments of the invention also provides a method for organizing data.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

DETAILED DESCRIPTION

The following description of various embodiments is merely exemplary in nature and is in no way intended to limit the invention, its application, or uses.

An operator is an entity that issues instructions, using an interface module. In one embodiment, the operator is a user. In one embodiment, the operator is a computer executing computer-executable instructions.

The term 'associated' is used for direct or indirect relationships between components.

In all figures, a stack of blocks, i.e. a block with another block partially hidden behind, represents one or more instances of the component indicated by the block.

An identifier is used for uniquely identifying a component among other components in the same category. In the preferred embodiment, an identifier consists of a sequence of Unicode characters, which is a known concept in the art.

A UUID is a unique sequence of hexadecimal digits. It may also contain inserted hyphen characters. A UUID is a known concept in the art.

Figure 1:
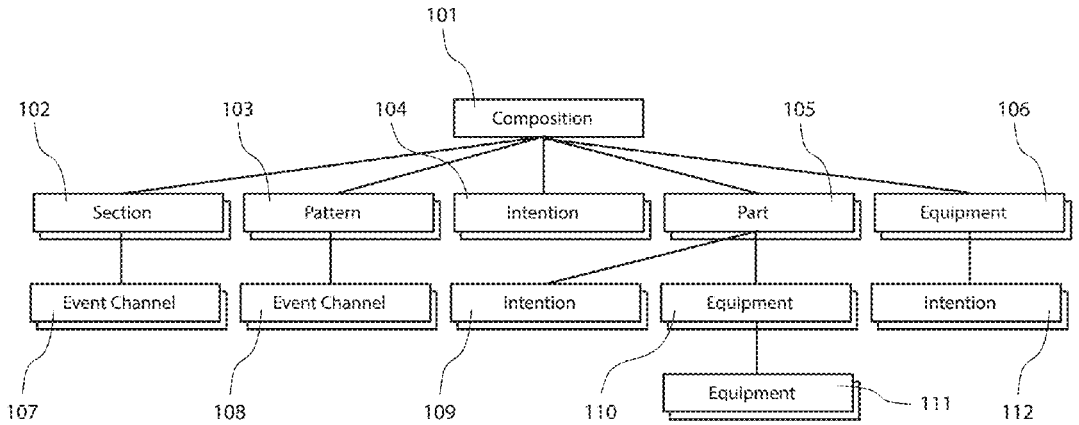
FIG. 1 is an exemplary block diagram illustrating some components of a composition.

In the preferred embodiment, the invention is used by an operator for creating a composition model, such as illustrated in FIG. 1. In other embodiments, the invention can generate a composition model from received data, e.g. audio, MIDI or images.

The composition model details are encoded as structures and events. The composition model may include patterns. In the preferred embodiment, patterns are used for dynamically adding temporary events to the composition where the composition lacks relevant, explicit events.

Intentions are used for describing categories of change. An operator may create custom intentions.

Exemplary intentions for the preferred embodiment are shown in Table 1.

TABLE 1

Exemplary intentions

| Intention | Change Description |
|---|---|
| attack | The time an effect uses to achieve full modification of a signal. |
| audio file | Presentation of an audio file. |
| bpm | Beats per minute. |
| chord | Base pitch and color of a chord. |
| complexity | Complexity of the music. |
| intensity | Intensity of the music. |
| key | The key of the composition. |
| lyrics | The lyrics of a part. |
| note | A note, comprising pitch, duration and volume. |
| output | The output volume of a section or part. |
| pitch | The pitch of a part. |
| spectrum | A spectrum distribution. |
| time signature | The time signature of a section. |
| transposition | The number of semitones a part or section should be transposed. |

There are sets of intentions not listed in Table 1 that represent similar but different categories of change. For instance, genre intentions include funk and blues. Function intentions include theme, solo and bridge. Phoneme intentions include various phonemes. Pattern intentions are used for describing the relative weights of individual patterns.

Referring to FIG. 1, in the preferred embodiment, a composition 101 has a list of intentions 104 that are relevant to all its sections and patterns, e.g. chord, key and bpm.

In the preferred embodiment, each part 105 has a list of intentions 109 that are relevant to said part, e.g. note and lyrics. Some intentions that are relevant for one part may not be relevant for all parts. For instance, lyrics may be relevant for a 'Vocal' part, but not for a 'Saxophone' part.

In the preferred embodiment, each piece of equipment 106, 110 has a list of intentions 111, 112 that are relevant to that piece of equipment, e.g. wetness and duration.

An intention value is a value associated with an intention. The intention value may be associated with a specific beat. The intention value may be associated with a section or a pattern. The intention value may be associated with a part and/or a piece of equipment. For instance, a bpm value, which is an intention value associated with the bpm intention, at beat 10 of the third section may be 92. Intention values may be numerical, or they may use another representation of a more complex value.

The terms 'composition', 'section', 'pattern', 'part' and 'equipment' are described below.

In the preferred embodiment, a beat represents a temporal location in a composition, section, pattern or performance. In other embodiments, a beat may represent the index of a task in a sequence of tasks.

A beat may be encoded as a fraction.

A beat may be encoded as a numerical value.

In the preferred embodiment, a beat duration represents the size of a temporal interval. For instance, the beat duration between beats one and five is four. In other embodiments, a beat duration may represent the size of an interval of adjacent tasks.

A beat duration may be encoded as a fraction.

A beat duration may be encoded as a numerical value.

A measure has a start beat and a beat duration.

A time signature intention value is used for determining the beat duration of a measure at a provided beat. It is also used for determining the note value duration at said beat. For instance, if the time signature value at a provided beat is '3/4', the beat duration of the measure at this beat is 3, and the note duration of each beat is one quarter note. The first measure may start at beat 1. The second measure may start at beat 4 and so on.

Some time signature values may correspond to special methods for calculating beats per measure. For instance, '12/8' may use a measure duration of four beats, with three eighths notes per beat.

A tempo is a measurement of performance speed.

A tempo may be measured as beats per minute (bpm). This measures the number of beats that have passed per minute during a performance.

A tempo may change during the duration of the composition.

The tempo may be used for calculating the number of seconds since the performance start.

A pitch represents the base frequency of a sound. In the preferred embodiment, the pitch represents the number of semitones higher than the pitch C0, which is a known concept in the art.

A pitch may be encoded as a numerical value.

Figure 2:
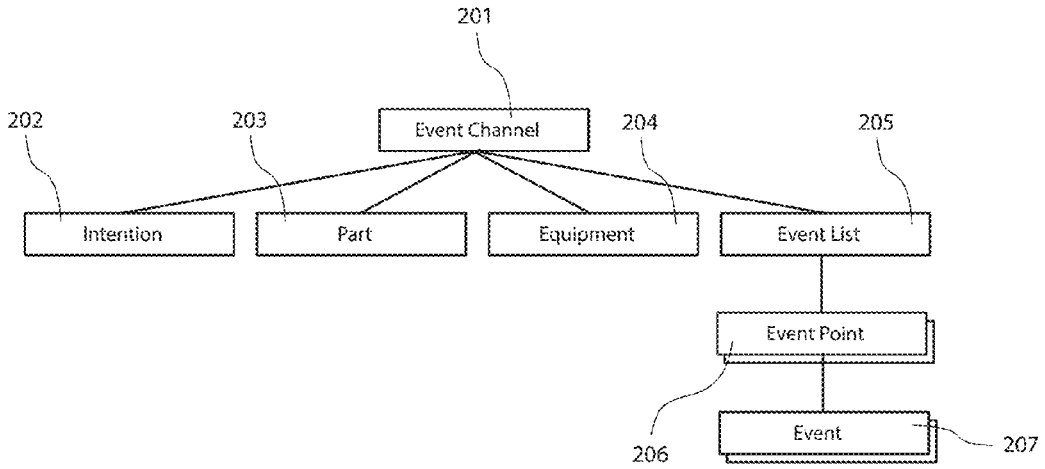
FIG. 2 is an exemplary block diagram illustrating some components of an event channel.

In FIG. 2, an exemplary block diagram illustrates the structure of an event channel 201.

An event 207 represents a change of an intention value. An event contains the new intention value.

An event is associated with an intention. For instance, a chord event is associated with the chord intention. The intention associated with the event determines the type of values the event may contain. For instance, a chord event may not contain information about lyrics or notes.

In the preferred embodiment, an event may or may not have a beat duration. If the event has no beat duration, it is valid until a new event becomes active. For instance, a note event has a beat duration but a chord event is valid until the next chord event.

An event may contain a numerical value, like output audio volume or bpm. If the event contains a numerical value, the value may be stationary until next event, or change in some way until the next event, e.g. a linear or quadratic change.

An event may contain a text value, e.g. lyrics, an identifier or a file path.

An event may contain a text value that encodes a complex value, like an encoded guitar chord chart.

An event may contain combinations of intention values. In the preferred embodiment, note events may contain pitch, volume, pan and sustain. Chord events may contain pitch and chord color.

An event point 206 represents the occurrence of one or more events. Each of the said events are associated with the event point.

In the preferred embodiment, the event point is associated with a beat. The beat may be the beat duration since the beginning of a section, pattern or performance. An event point may contain a single event, e.g. a chord or key event, or multiple events, e.g. multiple note events at the same beat, in which case each note event may have a beat duration that differs from other note events of the event point.

All events of an event point have the same intention, which is called the intention of the event point.

An event list 205 is a list of event points. In the preferred embodiment, all event points in the list must be associated with different beats. In the preferred embodiment, the list is ordered. The order is based on the beats associated with the event points. All event points of an event list have the same intention. This intention is called the intention of the event list.

Events with a beat duration are associated with the beat of the associated beat point. Events without a beat duration are associated with each beat in a beat interval. Said beat interval starts with the beat associated with the event point associated with said event, and ends at the beat associated with the next event point, i.e. the event point in the event list associated with the least beat that is greater than the beat associated with the event point associated with said event. If there is no next event point, said beat interval ends at the end of the section or the pattern.

In the preferred embodiment, an event channel 201 is used for associating events 207 with combinations of an intention 202, a part 203 and a piece of equipment 204. The references to part and piece of equipment are not required for an event channel. An event channel contains an event list 205 with the associated events 207. The intention 202 of the event channel must be equal to the intention of the event list 205.

Referring to FIG. 1, in the preferred embodiment, a section 102 is used for defining intention values during some temporal interval of a composition performance. In other embodiments, a section may be used for defining intention values in a subsequence of tasks.

Some or all of the combined intention values of a section may be called the behavior of the section.

A section may have a name, e.g. 'Refrain' or 'Chorus'.

A section has a beat duration. A section may also have a number of precount (anacrusis) and postcount beats.

A section has a list of event channels 107.

Each combination of intention, part and equipment is unique for an event channel among event channel elements of an event channel list 107 of a section 102.

A pattern 103 may be used by an arranger to create temporary events. In the preferred embodiment, a pattern is normally associated with events for notes, time signatures, keys and/or chords, but a pattern may be associated with events which are associated with any intention, e.g. audio file events for recorded guitar riffs.

Like sections, patterns have a list of event channels 108. The events associated with these event channels represent the changes associated with the pattern. Each combination of intention, part and equipment is unique for an event channel among event channel elements of an event channel list 108 of a pattern 103.

A part is an actor in the composition, i.e. a component that contributes to the presentation of the composition. In the preferred embodiment, a part 105 is a separate voice or sound of a composition. In other embodiments, a part may be a performance effect, a motorized machine, a spotlight, a video source, or any other component contributing to the presentation.

In the preferred embodiment, a part generally has the name of its sound, like 'Piano' or 'Acoustic Drums', although it may have another name, like 'Soprano', 'Tenor' or 'Bob'.

In the preferred embodiment, a part has a list of intentions 109 which may be used for the part, e.g. 'note' and 'lyrics'. Other parts of the same composition may not have the same set of intentions. For instance, 'lyrics' may be missing from a 'Saxophone' part.

In the preferred embodiment, a piece of equipment represents a performance effect, e.g. 'Reverb' or 'Compressor'. In other embodiments, a piece of equipment may represent any actor in the composition which is not defined as a part. Normally, a piece of equipment modifies a signal which is produced by a part or another piece of equipment.

In the preferred embodiment, a part has a list of its pieces of equipment 110.

If an event channel has no reference to a part and no reference to a piece of equipment, the event channel events applies to all parts and equipment during the duration of the section or pattern. These events may be called section events. Examples of section events include chord, key, bpm and time signature events.

If the event channel has a reference to a part but no reference to a piece of equipment, the event channel events applies to said part during the duration of the section or pattern. These events may be called part events. Examples of part events include lyrics and note events.

If the event channel has a reference to a piece of equipment but no reference to a part, the event channel events applies to said piece of equipment during the duration of the section or pattern. These events may be called master events. Examples of master events include master reverb wetness events.

If the event channel has both a reference to a part and a reference to a piece of equipment, the channel events applies to said piece of equipment during the duration of the section or pattern. In the preferred embodiment, said piece of equipment modifies a signal for said part. These events may be called equipment events. Examples of equipment events include guitar echo delay events.

A section may contain a list of sections that it depends on. The sections in the list are called subsections of the section that contains the list. The section that contains the list is called a supersection of the sections in the list. In the preferred embodiment, a section with subsections has a behavior which is completely defined in the subsections.

In the preferred embodiment, a composition represents a musical composition or a song.

In other embodiments, a composition may represent any collection of ordered changes, e.g. a sequence of tasks or steps.

In the preferred embodiment, a composition 101 is a supersection, and it has a number of subsections, corresponding to the sections 102 of the composition model.

A composition may also have a list of patterns 103.

A composition may also have a list of intentions 104.

A composition also has a list of parts 105.

A composition may also have a list of pieces of equipment 106.

All section events are contained in the event channels 107 of the sections.

All pattern events are contained in the event channels 108 of the patterns.

For instance, to find the chord events of a section without subsections, you retrieve from the event channel list of said section an event channel associated with the chord intention. The chord events apply to all parts and pieces of equipment, so said event channel will not be associated with any part or any equipment. Said event channel 201 has an event list 205, which contains the chord events 207.

To find the note events of a specific part for a supersection, e.g. a composition, you collect from the event channel list of each subsection of the supersection the event channels with an association with the note intention, an association with the specific part and no association with any equipment. This will result in a collection of at most one event channel per subsection. Collect the events of the event list of each collected event channel.

In the preferred embodiment, each section begins where the previous section ends. Thus, the beats associated with the events must be adjusted for preceding sections. For each subsection, calculate the sum of the beat durations of all subsections preceding said subsection, and associate each of the collected events associated with said subsection with a beat which equals the beat associated with said event increased by the calculated sum of preceding subsection beat durations.

In other embodiments, sections may encode different behavior during the same sequence, with intention values, e.g. an opacity value, directing how much each section influences a presentation.

An event channel 107, 108 may be part of the event channel lists of multiple sections and/or patterns, if the events of the event channel should be duplicated.

In the preferred embodiment, the list of intentions 104 of the composition 101 determines which intentions are allowed for an event channel which has no part or equipment, e.g. chord, key and time signature.

In the preferred embodiment, the list of intentions 109 of a part 105 determines which intentions are allowed for an event channel which is associated with said part but no equipment, e.g. note and lyrics.

In the preferred embodiment, the list of intentions 112 of a piece of equipment in the list of equipment 106 of a composition 101 determines which intentions are allowed for an event channel which is associated with said equipment but no part, e.g. master reverb wetness of a master reverb effect.

In the preferred embodiment, the list of intentions 111 of a piece of equipment in the list of equipment 110 of a part 105 determines which intentions are allowed for an event channel which is associated with said equipment and said part, e.g. echo delay of a delay effect that is used only for this part.

Figure 3:
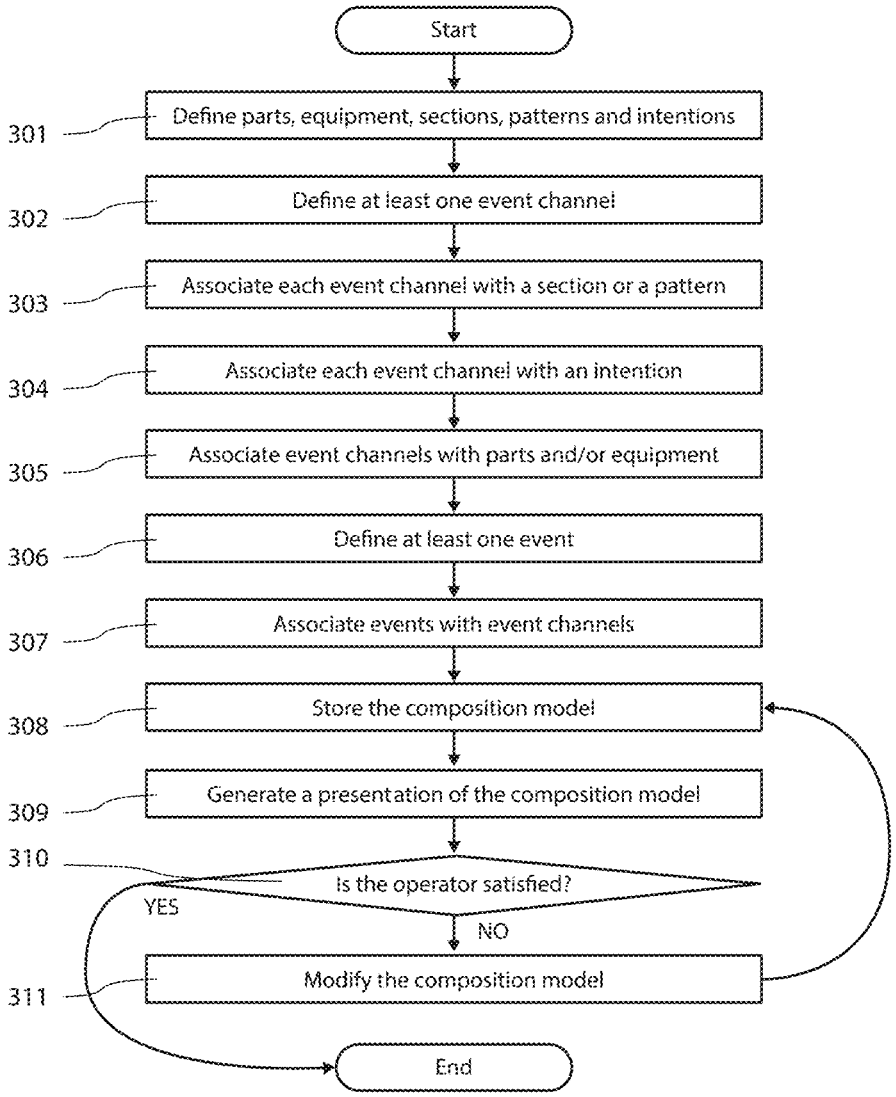
FIG. 3 is an exemplary flow chart illustrating creation and modification of a composition model.

FIG. 3 shows an exemplary flow chart illustrating how an operator creates and modifies a composition model using the preferred embodiment of the invention.

An operator uses said embodiment to define parts, equipment, sections, patterns and intentions 301. The operator defines event channels 302 and associates each event channel with a section or a pattern 303. The operator associates each event channel with an intention 304. The operator associates some event channels with parts and/or pieces of equipment 305. The operator defines the events 306, and associate each event with an event channel 307, e.g. by using event points and event lists. Each of said defined events contains its value. The order of said definitions and associations is not important. Some steps may be performed multiple times. The composition model now has an initial content, which is stored on a computer-readable media 308.

The invention may be used for generating a presentation, e.g. audio or images, based on the content of the composition model 309.

If the operator is satisfied with the presentation 310, the composition model is complete, and the presentation may be exported, e.g. as audio or as images, using musical notation known in the art.

If the operator is not satisfied 310, the operator modifies the composition model 311, and continues this cycle of modification 308-311 until the operator is satisfied 310.

Events that are associated with a section may be called section events. They will make the same contributions to a presentation every time.

Patterns are used for temporarily adding events to a section. These events may be called temporary events.

In the preferred embodiment, an event environment may be used for accessing events associated with a provided intention, a provided part, a provided piece of equipment and a provided beat.

In embodiments without an explicit event environment, any direct access to section events have the same effect, and should be considered identical to the use of an event environment.

In one embodiment, an event environment returns section events of a provided section, wherein the event channels associated with the events are associated with the provided intention, the provided part and the provided equipment.

In other embodiments, an event environment may return events determined by an operator during a performance.

In yet other embodiments, an event environment may return a combination of the previously described methods.

An arranger is a module which is used for adding temporary note events to a section. In one embodiment, the events may be stored in a composition model. In one embodiment, the events exist only during the generation of a presentation.

In one embodiment, each part is associated with a unique arranger. In other embodiments, several parts may share arrangers. This makes it possible for the arranger to enforce or prevent some behavior, e.g. parallel movements of notes for different parts.

Figure 4:
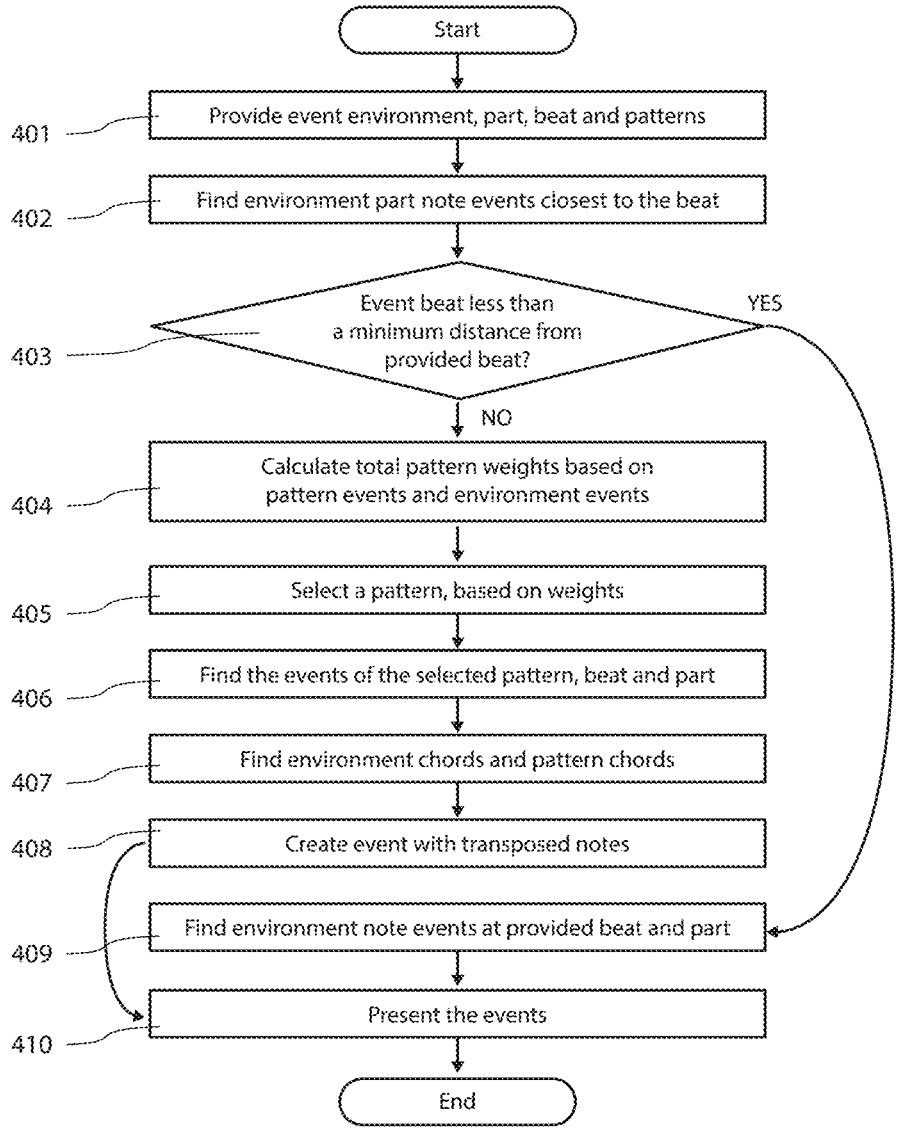
FIG. 4 is an exemplary flow chart illustrating an exemplary arranger producing note events.

FIG. 4 shows an exemplary flow chart illustrating the creation of temporary note events in the preferred embodiment, with a provided event environment, a provided part, a provided beat and a provided set of patterns 401.

In the preferred embodiment, section events will disable the creation of temporary events closer to itself than a minimum beat distance. In the preferred embodiment, the minimum beat distance is defined in the arranger module. In other embodiments, the minimum beat distance may be defined by the operator. As the operator creates more section events, the intervals available for temporary events become smaller. This implies that the use of patterns are increasingly limited. The patterns become obsolete if the whole duration of the composition is fully covered by section events.

In the preferred embodiment, the arranger uses the event environment to retrieve the environment note events, associated with the provided part, which are closest to the provided beat 402. If there are environment part note events closer to the provided beat than a minimum distance 403, the arranger finds the environment note events associated with the provided beat and part 409 and presents those note events 410.

Otherwise, the arranger creates temporary note events.

First, the arranger calculates the total pattern weights (TPW) 404. A method for calculating TPW is described below.

Figure 10:
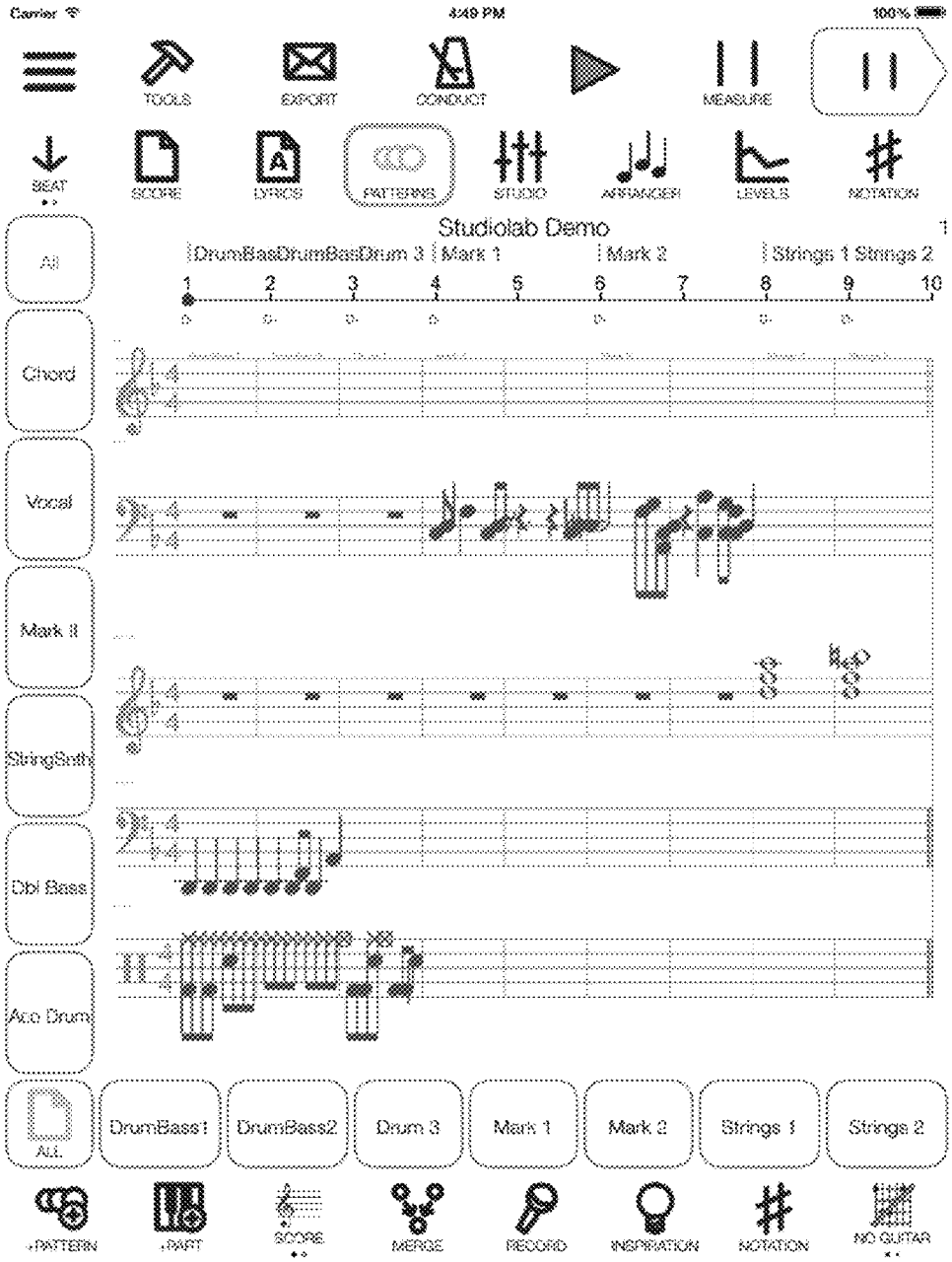
FIG. 10 is an exemplary embodiment of a user interface for viewing composition patterns.

When the arranger has calculated the TPWs for each pattern at the provided beat, it must determine which pattern to use 405. In the preferred embodiments, patterns with no note events associated with the provided part cannot be selected. FIG. 10 illustrates how each pattern may be limited to a subset of parts.

The arranger may increase the TPW of the last pattern used, to create notes sequences with more consistency, or to use a musical theme.

The arranger may increase the TPW of a pattern with a specific chord, pitch, scale or rhythm may be preferred, e.g. if it matches environment values.

The arranger calculates the sum of all TPWs of all patterns and selects a pattern based on its TPW share.

When a pattern has been selected, its note events associated with the provided part and its pattern beat are selected 406. The pattern beat of a pattern is described below.

The events may have to be adjusted. For instance, if both the pattern and the environment have chord events 407, the pattern notes may be transposed by the difference between the environment chord pitch and the pattern chord pitch 408. In addition to changing the pitch based on the chord pitches of the environment chord and the pattern chord, individual note events may be altered, based on the chord color differences. For instance, if the pattern chord color is minor and the environment chord color is major, any minor third note event of the pattern, compared to the chord pitch of the pattern chord, may be transposed to a major third, compared to the chord pitch of the environment chord. This method of transposition is known in the art.

The events are then presented 410. The pattern may have no events at the specific beat, in which case no events are presented.

Figure 5:
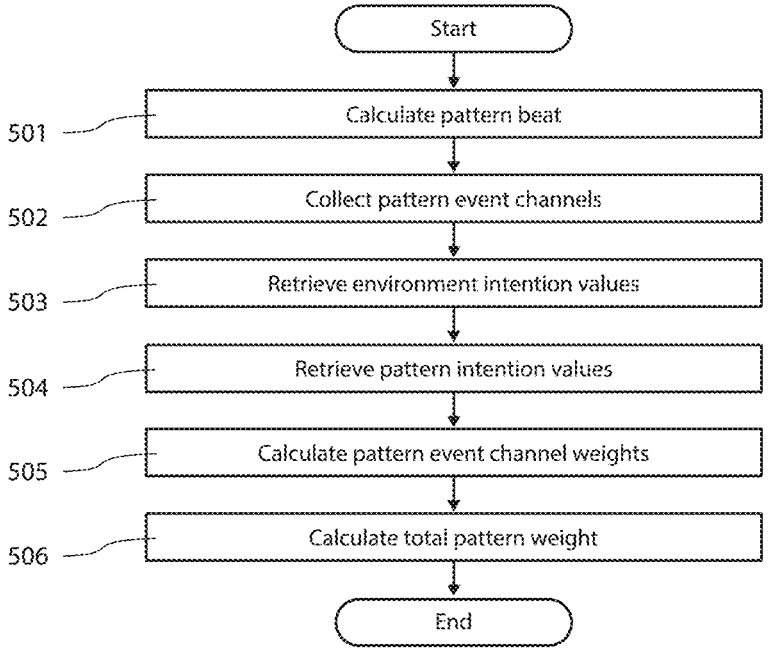
FIG. 5 is an exemplary flow chart illustrating an exemplary arranger calculating total pattern weights.

FIG. 5 shows an exemplary flow chart illustrating a calculation of the total pattern weight (TPW) of a provided pattern, a provided part and a provided beat.

First, the arranger calculates the pattern beat corresponding to the provided beat for the provided pattern 501. The pattern beat is restricted to the beat duration of said pattern. In the preferred embodiment, the first beat of a section corresponds to the first beat of all patterns. Increasing the section beat correspond to increasing the pattern beat of each pattern by the same amount. Each time the pattern beat reaches the beat duration of its pattern, which normally is less that the beat duration of the section, the pattern beat is reset to the first beat. If the time signature value of the event environment is different than the time signature value of the pattern, beats of the pattern may be repeated or removed. The arranger collects all pattern event channels of the event channel list 108 of the provided pattern, which have no part or a part that equals the provided part 502.

For each event channel in the collection, the arranger calculates a pattern event channel weight (PECW). To calculate PECW of a pattern event channel, the arranger retrieves environment events 503 associated with the provided beat, the part of the pattern event channel 203, and the intention of the pattern event channel 202. If no environment events are found, the arranger retrieves environment events associated with the provided beat and the intention of the pattern event channel, thus retrieving section events instead of part events. This makes it possible to control multiple parts with single events, while enabling individual parts overriding the event. The retrieved environment events, normally converted to a numerical value, may be called the environment intention value.

The arranger retrieves events from the pattern event channel that are associated with the pattern beat of the pattern 504. The pattern events, normally converted to a numerical value, may be called the pattern intention value.

The arranger calculates the PECW of the pattern event channel 505. The PECW may reflect how well the pattern intention value matches the environment intention value. For instance, if the pattern intention value for the intensity intention at the pattern beat is 1.0, an environment intensity value of 1.0 at the defined beat would result in a high PECW for the pattern event channel associated with the intensity intention, since the intensities of the pattern and the environment match each other. An environment intensity value of 0.0 would result in a low PECW for the event channel associated with the intensity intention.

A total pattern weight (TPW) is calculated for each pattern, based on the PECW of each collected pattern channel 506.

Figure 12:
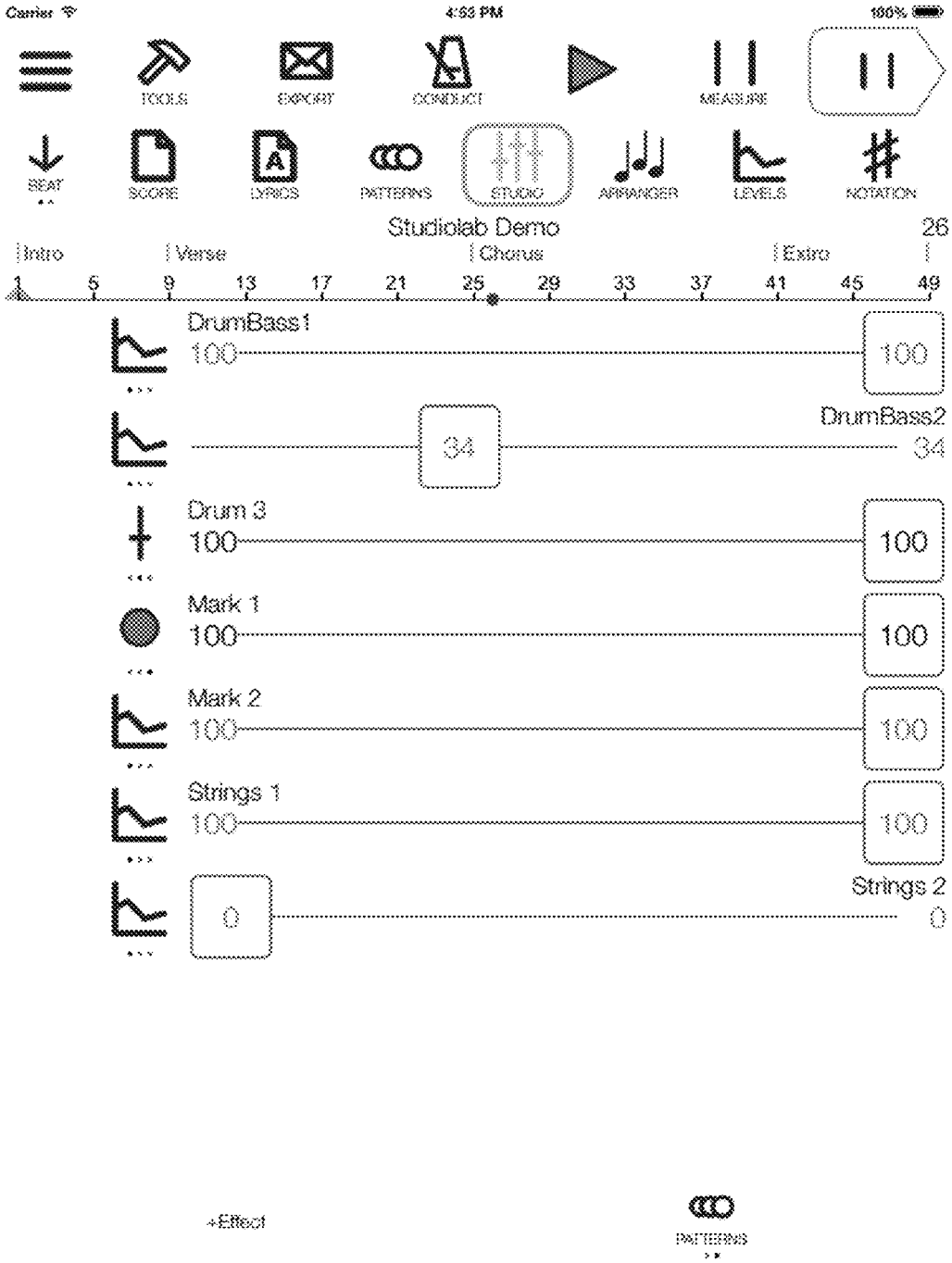
FIG. 12 is an exemplary embodiment of a user interface for viewing and editing pattern weights.
Figure 14:
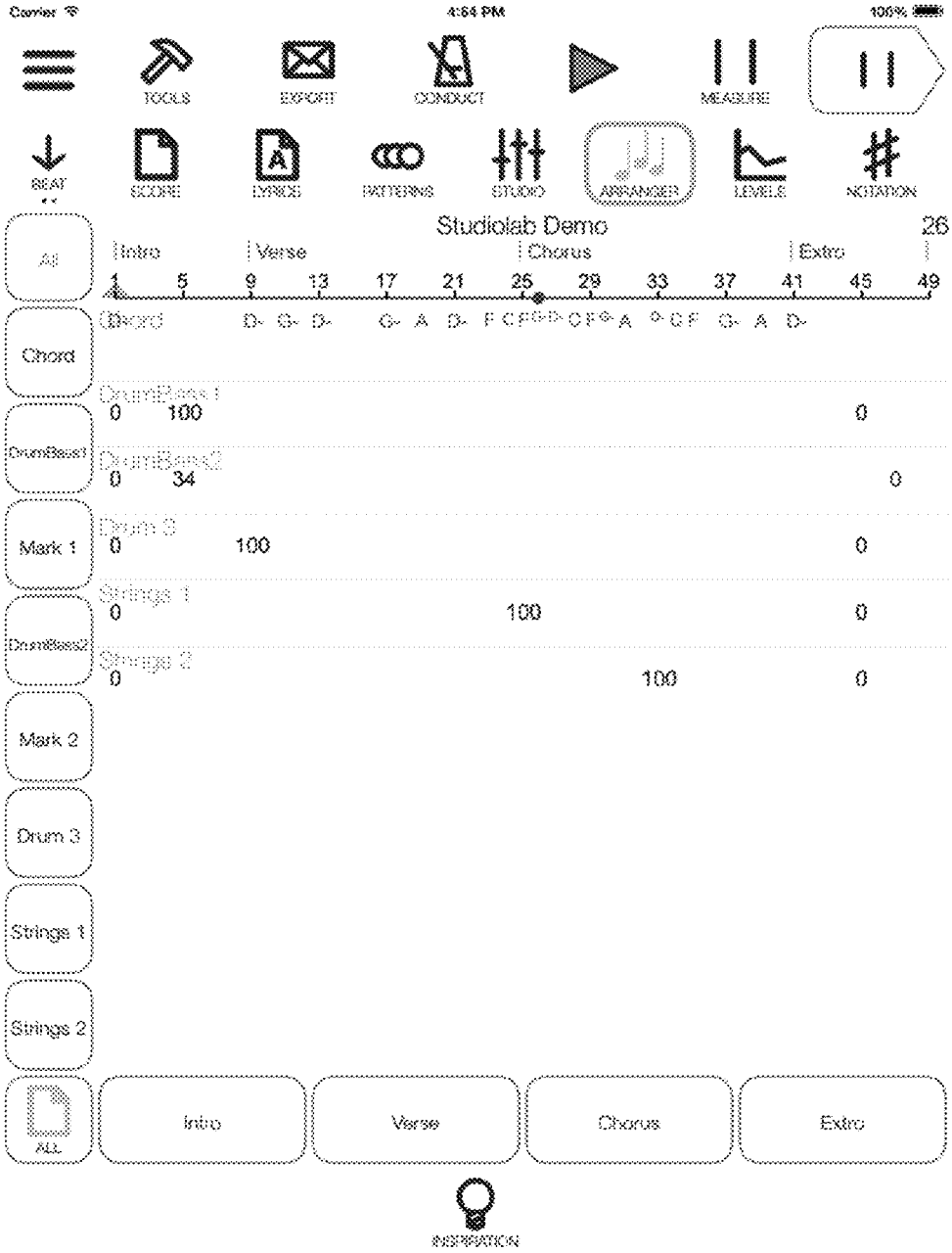
FIG. 14 is an exemplary embodiment of a user interface for viewing pattern weights.

In the preferred embodiment, each pattern has its own, special intention, called the pattern weight. It represents the relative weight of said pattern. This intention value may be used to alter the TPW of a pattern. A pattern weight of zero may be used for silencing a pattern completely. Exemplary user interfaces for viewing and modifying pattern weights are illustrated in FIG. 12 and FIG. 14.

One obstacle for composing in general is that emotional attachment of an operator to a produced version of a composition often correlates with the time it has taken to produce the version. This attachment often blocks decisions to make major changes. An arranger enables an operator to make major changes in the presentation, using minor modifications of structures and events. This reduces attachment during the initial composing, when experimenting is most important.

In the preferred embodiment, the events created by an arranger are streaming, i.e. they are calculated only when they should be used. This means that environment events may be adjusted manually in real time, which is practical during a performance.

In other embodiments, the events of an arranger may be calculated for the whole composition at one time, which would make it easier to coordinate notes and themes for various parts and sections.

The events of an arranger may be a combination of streaming and full calculation, in which case long intervals are calculated when needed, and possibly recalculated when intention values change.

In one embodiment, arrangers may adjust the creation of temporary events based on special principles, e.g. by inserting or removing events so the result sounds like an arrangement by Mozart.

In one embodiment, components called musicians may be used for converting note events to audio data, e.g. by using sampled or synthesized sound.

In one embodiment, musicians may adjust the events based on special principles, e.g. by inserting, removing or modifying events so the result sounds like a performance by Jimi Hendrix.

In one embodiment, components called composers may be used for modifying or creating environment events.

In one embodiment, composers may adjust the events of the section event channels based on special principles, e.g. by inserting, removing or modifying events so the result sounds like a composition by Brahms.

In one embodiment, composers may be used for randomly creating structure and events of the composition model.

This detailed description describes the creation of note events. In some embodiments, arrangers, musicians and composers may be used for creating other types of events, e.g. for controlling electrical equipment or video streams.

Figure 6:
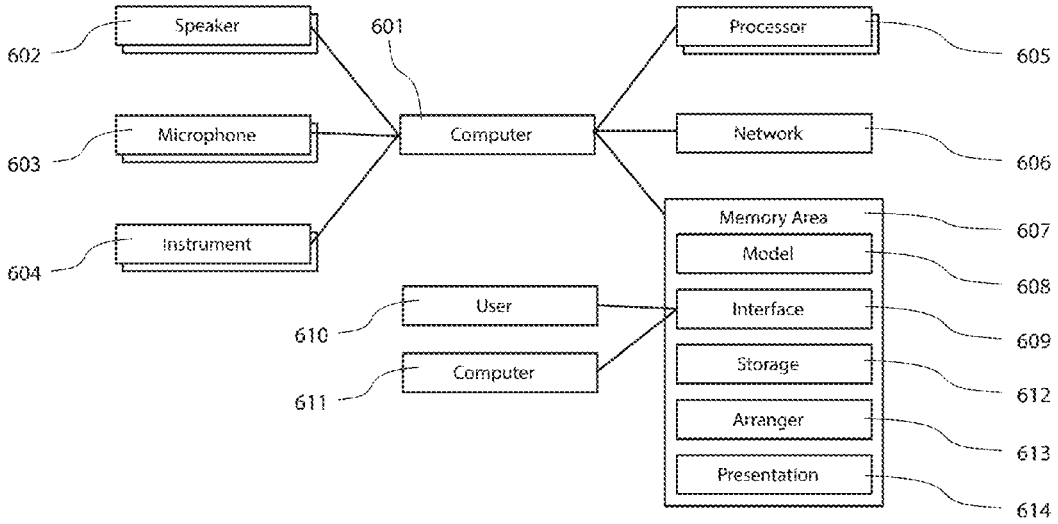
FIG. 6 is an exemplary block diagram illustrating an exemplary operating environment for aspects of the invention.

FIG. 6 illustrates an exemplary block diagram of an exemplary operating environment for aspects of the invention.

Embodiments of the invention may be implemented with computer-executable instructions. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein.

FIG. 6 shows one example of a general purpose computing device in the form of a computer 601.

Examples of well known computing systems, environments, and/or configurations that may be suitable for use with aspects of the invention include, but are not limited to, personal computers, server computers, hand-held or laptop devices, multiprocessor systems, microprocessor-based systems, set top boxes, programmable consumer electronics, mobile telephones, tablet computers, network PCs, minicomputers, mainframe computers, distributed computing environments that include any of the above systems or devices, and the like.

Computer-readable media, which include both volatile and nonvolatile media, removable and non-removable media, may be any available medium that may be accessed by computer 601. By way of example and not limitation, computer-readable media comprise computer storage media and communication media. Computer storage media include volatile and nonvolatile, removable and non-removable media implemented in any method or technology for storage of information such as computer-readable instructions, data structures, program modules or other data. Communication media typically embody computer-readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Wired media, such as a wired network or direct-wired connection, and wireless media, such as acoustic, RF, infrared, and other wireless media, are examples of communication media. Combinations of any of the above are also included within the scope of computer-readable media.

The computer 601 may operate in a networked environment 606 using logical connections to one or more remote computers. Generally, the data processors of computer 605 are programmed by means of instructions stored at different times in the various computer-readable storage media of the computer 601. Although described in connection with an exemplary computing system environment, including computer 601, embodiments of the invention are operational with numerous other general purpose or special purpose computing system environments or configurations. The computing system environment is not intended to suggest any limitation as to the scope of use or functionality of any aspect of the invention. Moreover, the computing system environment should not be interpreted as having any dependency or requirement relating to any one or combination of components illustrated in the exemplary operating environment.

In operation, computer 601 executes computer-executable instructions such as those illustrated in the figures to implement aspects of the invention.

The memory area 607 stores the components of the composition model 608 (e.g., parts, sections, patterns, event channels, events and event values). In addition, the memory area 607 stores computer-executable components including an interface module 609, a storage module 612, an arranger module 613 and a presentation module 614. The general purpose computer 601 is accessible by an operator using an interface module 609. The interface module 609 may receive, from an operator, commands and instructions to update the composition model and/or to generate a presentation. In one embodiment, said operator is a human user 610. Said user 610 may enter commands and information into computer 601 through input devices or user interface selection devices such as a keyboard and/or a pointing device (e.g., a mouse, trackball, pen, touch pad or touch-sensitive screen). In one embodiment, said operator is a computer 611. Said computer 611 may be a remote computer, transmitting commands and instructions using a network connection 606. Said computer 611 may be identical to the main computer 601, executing instructions defined in a computer-executable component. The storage module 612 defines the plurality of components of the composition model. A method for defining components is described below. The arranger module 613 uses the components of the composition model defined by the storage module to create a plurality of note events. The presentation module 614 uses the plurality of composition model components, e.g. those defined by the storage module and the arranger module, and produces presentation data. Said presentation data may be audio data. Said presentation data may be MIDI data. Said presentation data may be graphical images representative of the composition model, using musical notation known in the art. The memory area 607 may store the produced presentation data. The presentation data may be sent to a speaker 602, sent to an instrument 604 or presented to an operator, e.g. using the interface module 609.

In one embodiment, computer 601 has one or more processors or processing units, one or more speakers 602, access to one or more external instruments 604 via a MIDI interface or analog audio interface, access to one or more microphones 603, and access to a memory area 607 or other computer-readable media. The computer 601 may replicate the sounds of instruments such as instruments 604 and render those sounds through the speakers 602 to create virtual instruments. Alternatively or in addition, the computer 601 may communicate with the instruments 604 to send data to the instruments 604 for rendering.

Figure 7:
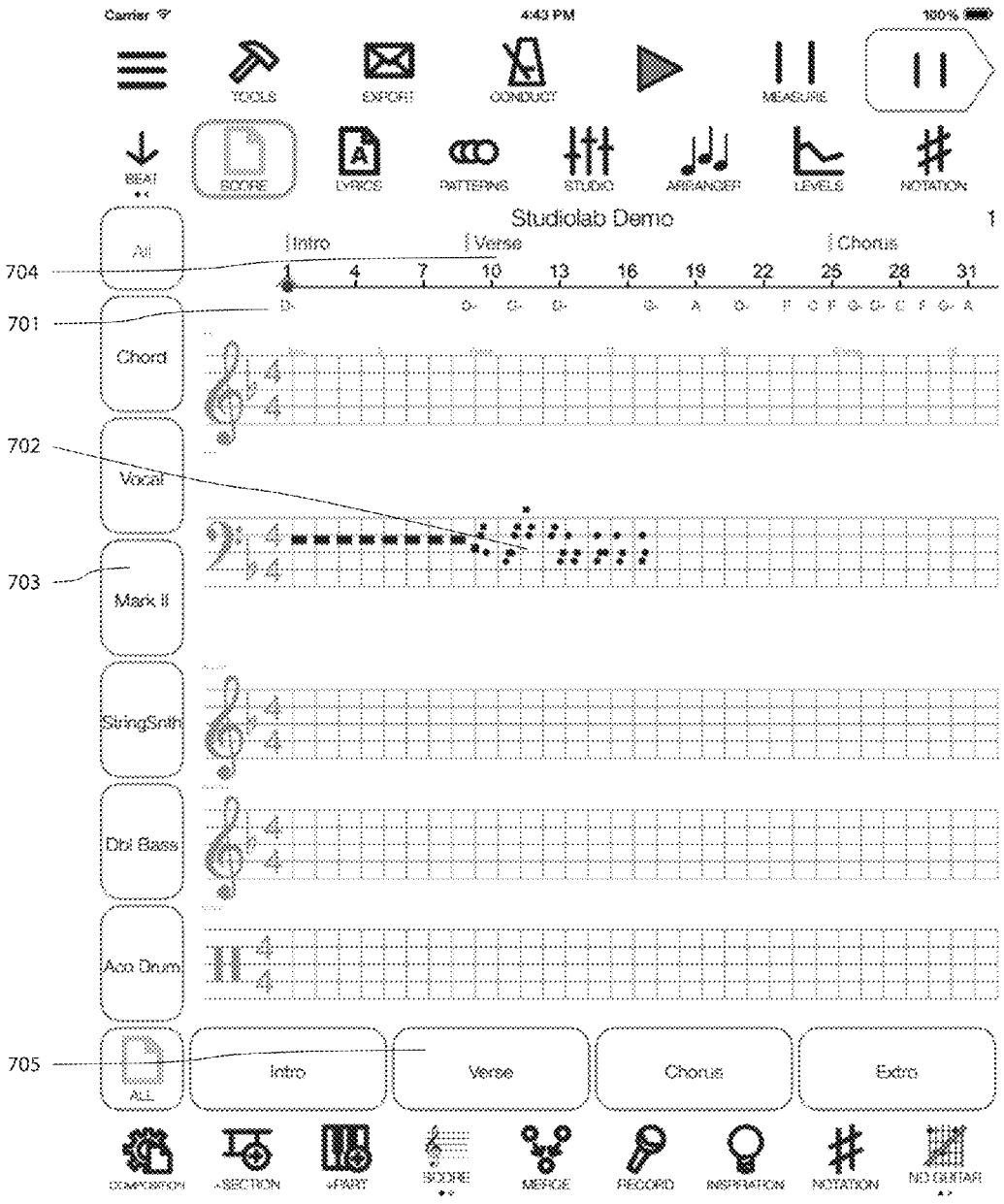
FIG. 7 is an exemplary embodiment of a user interface for viewing a composition.

FIG. 7 illustrates an exemplary user interface for a user to view the sections of a composition model. All sections have chord events 701. One note event channel of the composition 702, associated with one part 703 and one section 704, 705 has note events. In the preferred embodiment, the remaining combinations of parts and sections may use an arranger to create random note events, using the patterns illustrated in FIG. 10 and the pattern weights illustrated in FIG. 14.

Figure 8:
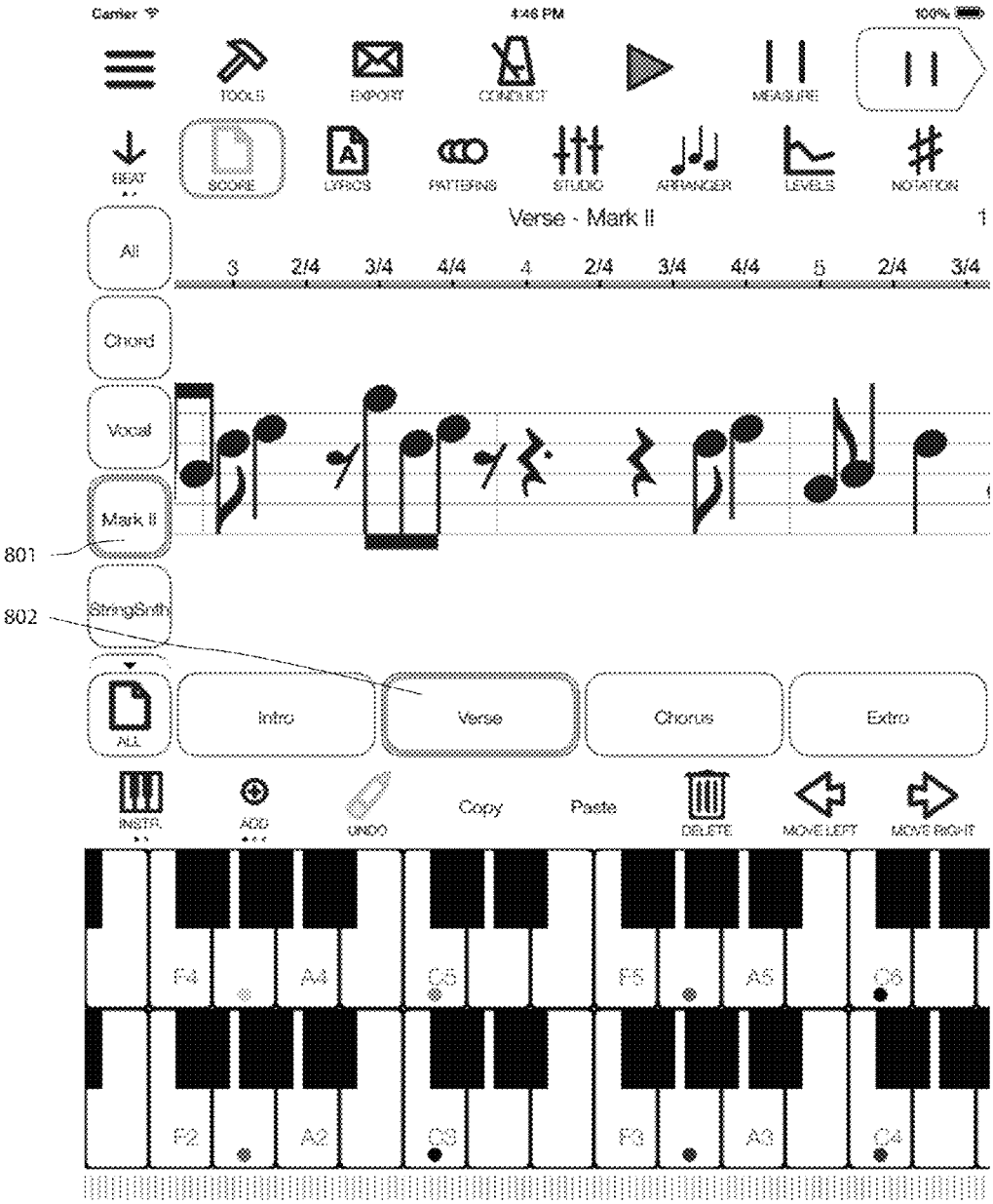
FIG. 8 is an exemplary embodiment of a user interface for editing notes of one part and one section.

FIG. 8 illustrates an exemplary user interface for a user to edit note events of one part 801 and one section 802.

Figure 9:
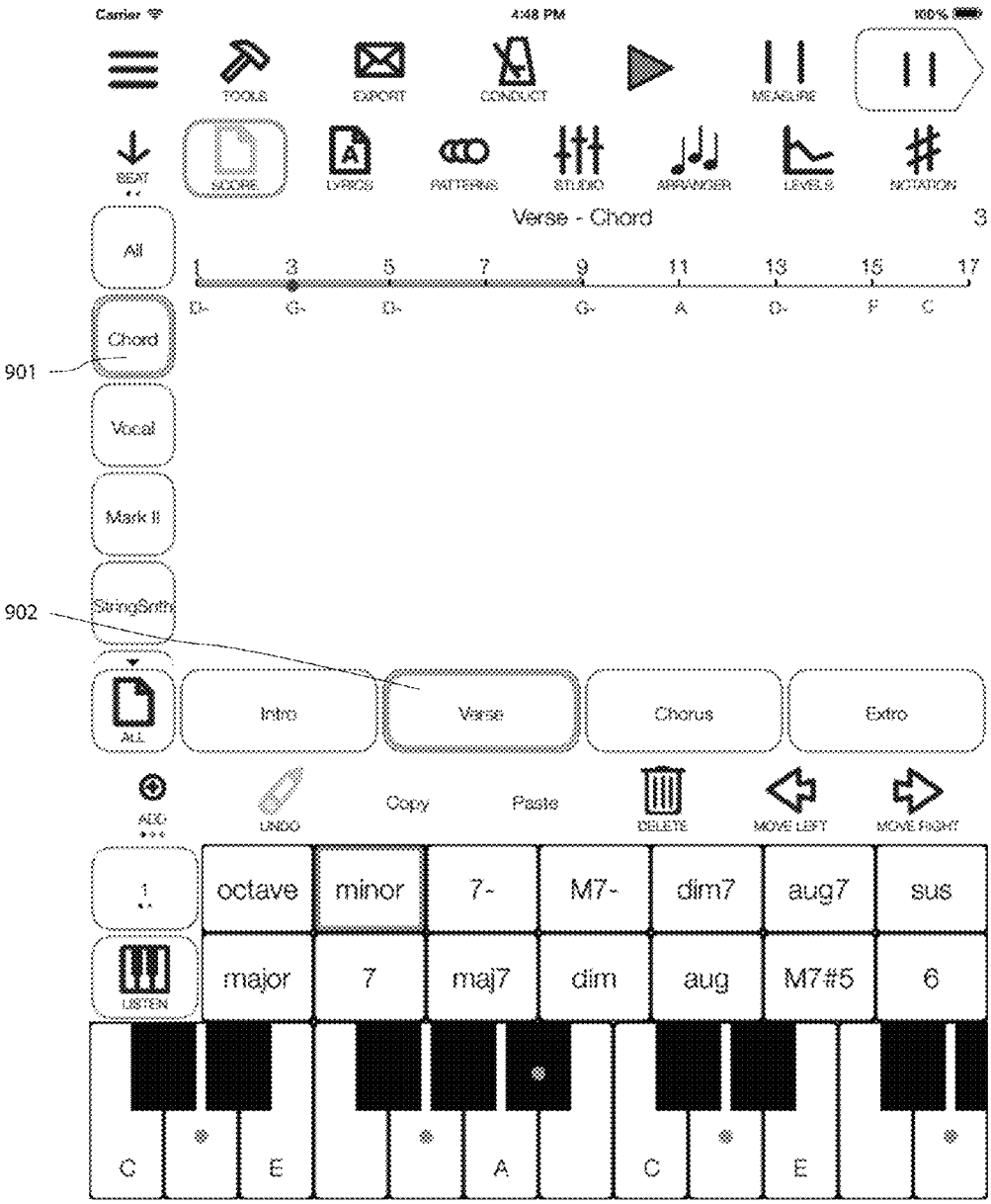
FIG. 9 is an exemplary embodiment of a user interface for editing chords of one section.

FIG. 9 illustrates an exemplary user interface for a user to edit chord 901 events of one section 902.

FIG. 10 illustrates an exemplary user interface for a user to view patterns of a composition. In the exemplary composition model, there are seven patterns. All said patterns have note events for at most two parts.

Figure 11:
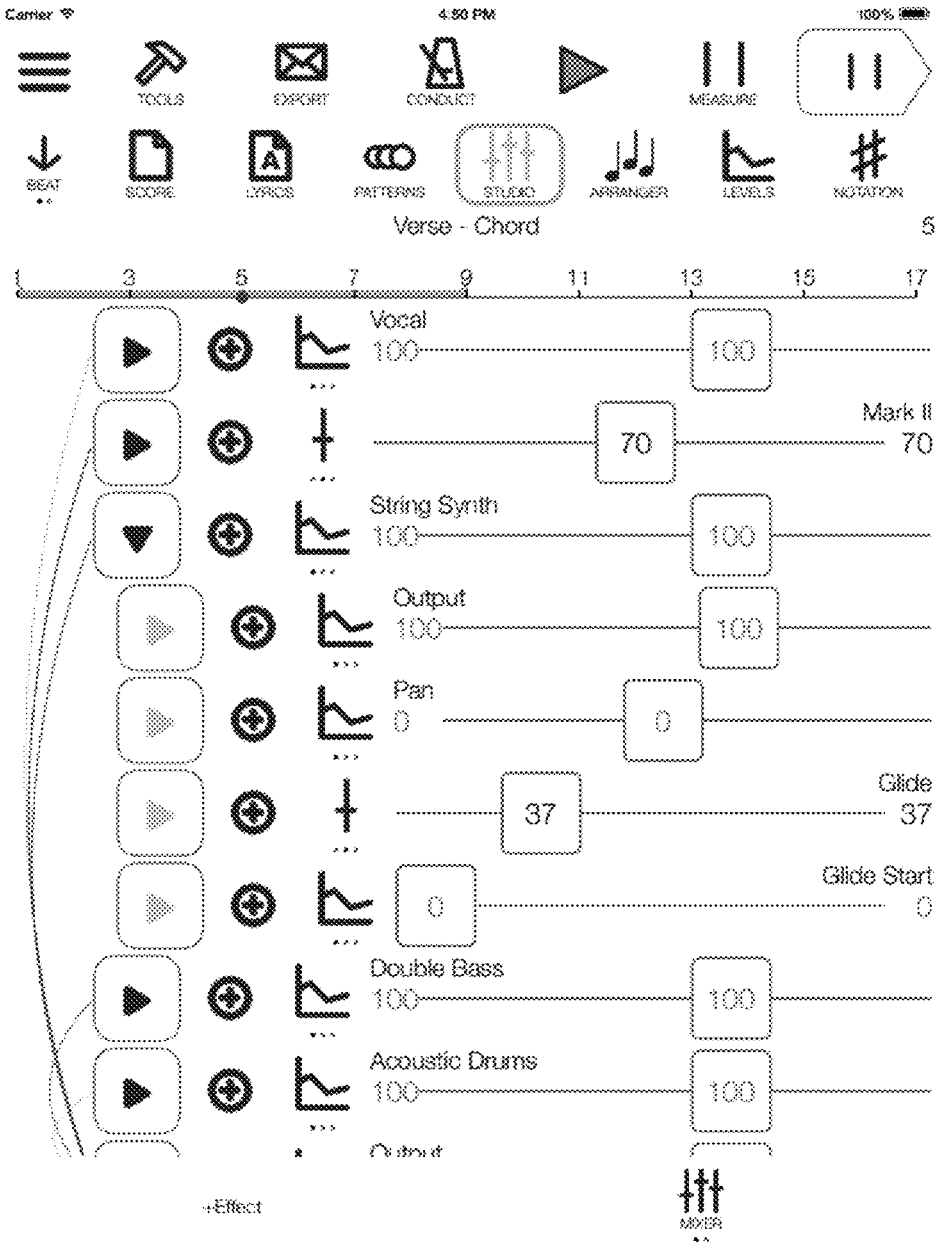
FIG. 11 is an exemplary embodiment of a user interface for viewing and editing equipment intention values.

FIG. 11 illustrates an exemplary user interface for a user to view and edit various intention values of one section of a composition model.

FIG. 12 illustrates an exemplary user interface for a user to view and edit pattern weights of the whole composition.

Figure 13:
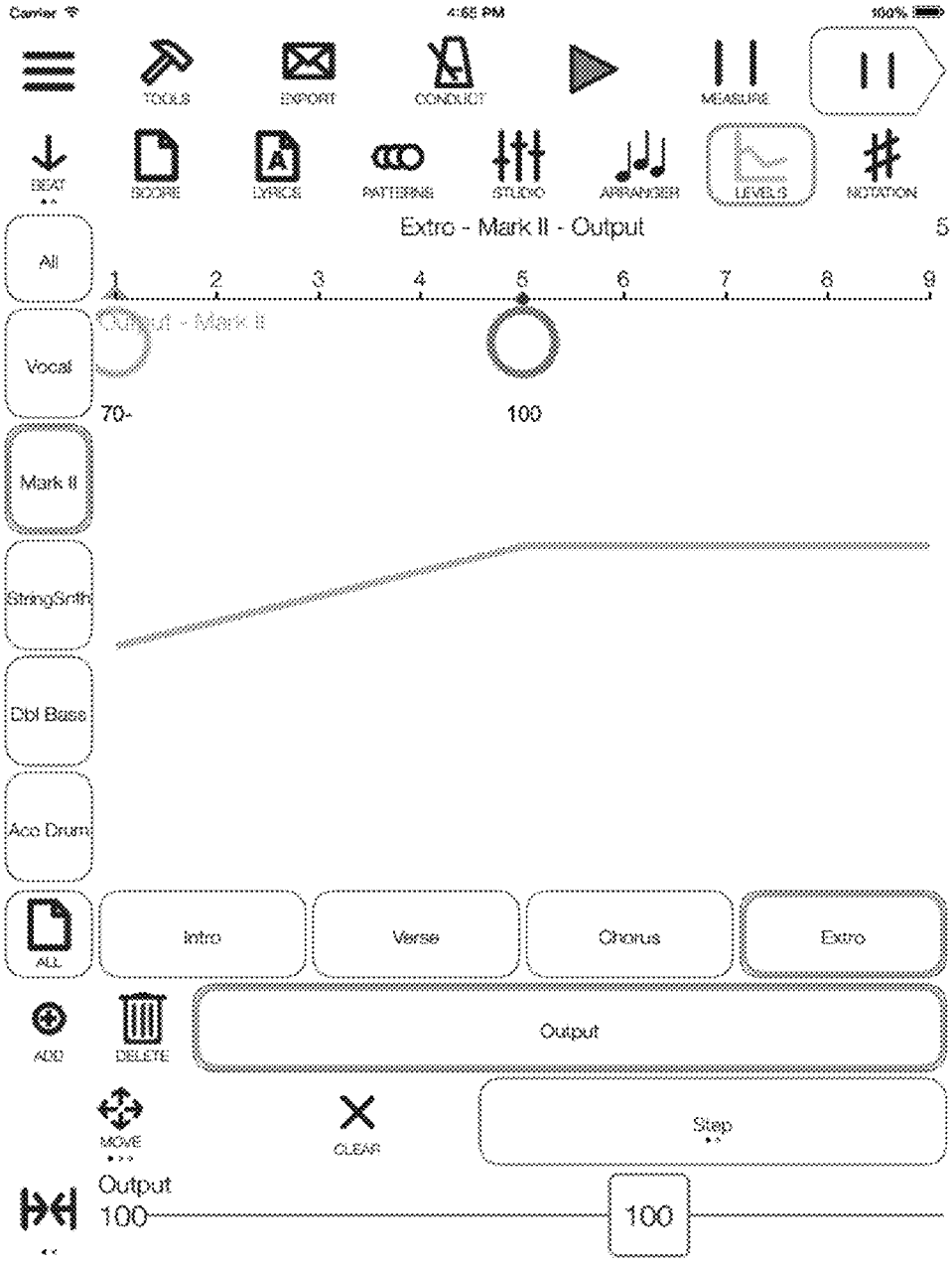
FIG. 13 is an exemplary embodiment of a user interface for viewing and editing intention values.

FIG. 13 illustrates an exemplary user interface for a user to view and edit intention values of one part and one section. In the example, the intention is the output volume. In the example, the value changes linearly from the first event to the second event, and then remains stationary until the end of the section.

FIG. 14 illustrates an exemplary user interface for a user to view pattern weights of a whole composition.

The memory area 607 stores the composition model. To do this, the computer 601 uses the computer-executable instructions of the storage module 612. In the preferred embodiment, the composition model is stored using a method for organizing data. In this detailed description, said method for organizing data will be referred to as 'the storage method', and the part of the memory area used for organizing data 608 will be referred to as 'the storage'. The preferred embodiment organizes data in a database in the storage 608.

Figure 15:
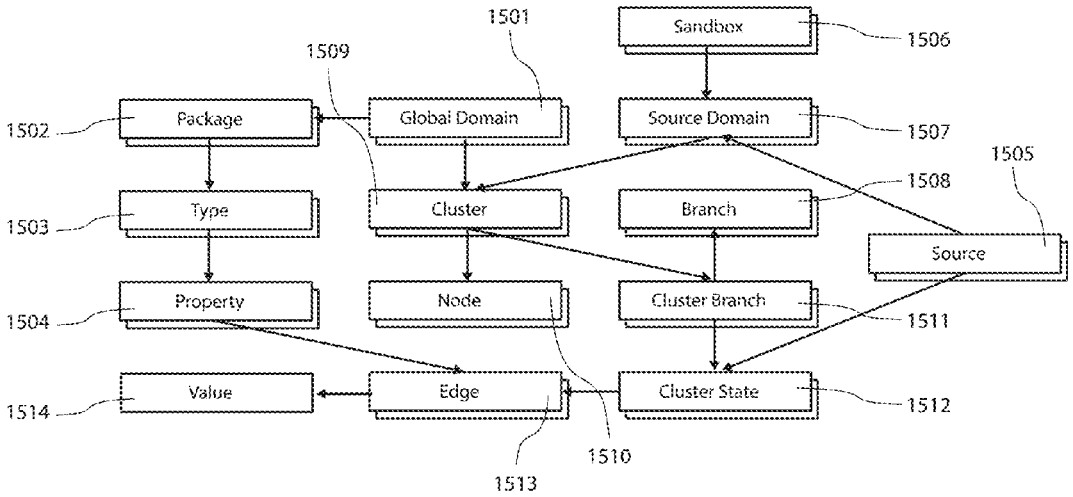
FIG. 15 is an exemplary block diagram illustrating the relations between some components produced using a data organization method.

FIG. 15 shows an exemplary block diagram illustrating the relations between some components produced using the storage method.

A global domain 1501 represents a set of information. A global domain has an identifier. In one embodiment, the identifier of a global domain may be 'unizone.org'.

A source 1505 represents a user, a group, an application, a service or any other entity that may edit or access content in the storage. A source has an identifier. In the preferred embodiment, the identifier of a source is a UUID.

A value 1514 represents a piece of information.

A value may represent a boolean.

A value may represent an integer.

A value may represent a real number.

A value may represent a text.

A value may represent a file in a file storage system.

A value may represent an array of values.

A value may represent a mapping from values to values.

A value may represent the central node 1510 of a cluster.

A value may represent a structure of relations and other values. Nodes 1510, other than the central node of the cluster, are represented as structures.

A type 1503 represents a category of nodes 1510 or values 1514 with the same behavior.

A type has an identifier. In one embodiment, the identifier of a type may be 'org.unizone.world.Person'.

A package 1502 represents a set of types 1503. A package has an identifier. In one embodiment, the identifier of a package may be 'org.unizone.world'.

A property 1504 represents a semantic meaning of an association between a node and a value. A property has an identifier. In one embodiment, the identifier of a property may be 'org.unizone.world.Person.address'.

A property is associated with a type 1503.

The storage stores information as a network of small, connected sets of information. These information sets are called clusters 1509. This approach enables minor modifications to be saved incrementally by only saving data of modified clusters.

A sandbox 1506 represents is a set of clusters 1509. A sandbox has an identifier. In the preferred embodiment, the identifier of a sandbox is a UUID.

A source 1505 may have its own domain within a sandbox 1506. This domain is called a source domain 1507. This source domain may be identified by the identifier of said sandbox and the identifier of said source. A source domain represents a subset of the clusters associated with said sandbox.

Each cluster 1509 is associated with a domain. The domain may be a global domain 1501 or a source domain 1507. Each cluster has a central node 1510 from which all other information in the cluster can be reached.

The central node 1510 of a cluster 1509 may be associated with any number of types 1503 to make it easier to search for clusters with a certain behavior, but any node may have edges with properties belonging to any type. For instance, a node representing a person could have edges with properties associated with a customer, a location and a user at the same time. In a way, the storage method supports multiple inheritance, which is a known concept in the art. The central node of a cluster does not have to be associated with any type.

An edge 1513 represents the association between the central node 1510 of a cluster 1509 and a defined value 1514. The defined value 1514 is called the value of the edge.

An edge is associated with a property 1504. The associated property describes the meaning of the association between the central node 1510 of the cluster 1509 and the value 1514.

Nodes in the cluster other than the central node may have properties as well. These nodes are stored as structured values, where the property and the target value of the relations of the node are encoded.

In the preferred embodiment, an integer uniquely identifies the central cluster node 1510 of a cluster 1509 within its domain. This integer may be called the cluster integer. Values 1514 associated with the central node 1510 of a cluster 1509 may be accessed using edges 1513.

In the preferred embodiment, a cluster associated with a global domain may be identified by the global domain identifier and the cluster integer. In the preferred embodiment, a cluster associated with a source domain may be identified by the sandbox identifier, the source identifier and the cluster integer.

A cluster state 1512 is used for storing one version of all edges 1513 of the central node 1510 of a cluster 1509.

In the preferred embodiment, a cluster state 1512 is associated with the time when it was created. This associated creation time may be used for removing old, inactive information, and for merging two sets of clusters.

In the preferred embodiment, a cluster state 1512 is associated with the source 1505 that created it. This allows for filtering information based on properties of the source, e.g. ignoring automatically generated content.

Figure 18:
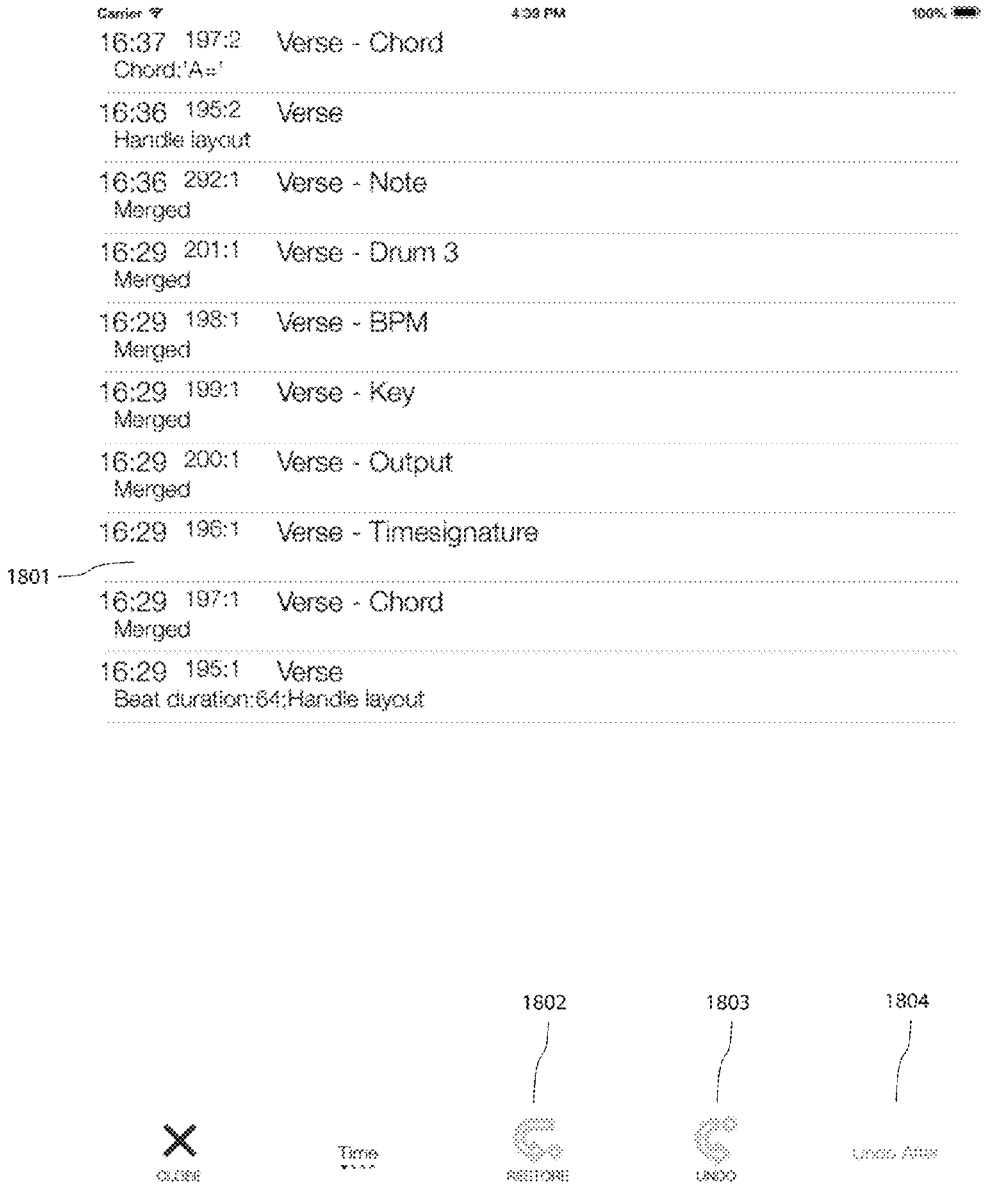
FIG. 18 is an exemplary embodiment of a user interface for viewing cluster state versions.

In the preferred embodiment, cluster states are associated with a text describing the changes compared with the previous trunk cluster state. FIG. 18 illustrates an exemplary user interface for displaying said texts. In the figure, 'Handle layout' and 'Merged' are said texts associated with the cluster state.

In the preferred embodiment, branches 1508 are used for keeping track of different sets of cluster states. Branches makes it possible to switch between different sets of clusters and edges, just by selecting which branch to use. A branch may have an identifier.

In the preferred embodiment, a cluster branch 1511 associates a cluster 1509 and a branch 1508 with a set of cluster states 1512. The cluster branch 1511 keeps track of the trunk cluster state. The trunk cluster state of a cluster 1509 for a given branch 1508 is the cluster state 1512 that is associated with the current edges of said cluster 1509.

Restoring an old cluster state 1512 of a cluster branch 1511 is done by changing the trunk cluster state of the cluster branch to the old cluster state.

Cluster states may have an indirect references to a branch, e.g. by using a hierarchy of branches, in which cluster states associated with a parent branch of a defined branch may be used if no cluster state is associated with the defined branch.

In other embodiments, there are no branches. The cluster states 1512, including the trunk cluster state, are then associated directly with the cluster 1509.

In the preferred embodiment, the following method may be used for adding edge information about a provided cluster 1509 to the storage, using a provided branch 1508:

- Create a new cluster state 1512 and associate values 1514 with the cluster state using edges 1513.
- Retrieve the cluster branch 1511 associated with the provided cluster and the provided branch.
- Associate the created cluster state 1512 with the retrieved cluster branch 1511.
- Set the trunk cluster state of the retrieved cluster branch to the created cluster state.

The only altered storage value is the trunk cluster state of the cluster branch. Nothing is removed. All cluster states, edges and values are added before the trunk cluster state is altered. This limits the risk for storage corruption issues.

Cluster states which are not the trunk state of any cluster branch, and which have been created before a time limit, e.g. a week, may be removed from the storage using a garbage collection process. This allows an operator to undo individual cluster edits that are younger than the time limit. FIG. 18 illustrates an exemplary user interface for this.

In the preferred embodiment, all domains, including global domains 1501 and source domains 1507, have their own integer number series for cluster integers. This implies that each source 1505 is responsible for the numbering of its own clusters 1509 within each of its source domains 1507. This makes it possible to synchronize sandbox 1506 content across different memory areas without creating conflicting cluster integers.

The central node 1510 of a cluster 1509, associated with a source domain 1507, associated with a sandbox 1506 can be the value 1514 of an edge 1513 only if said edge is associated with the same sandbox 1506, via a cluster state 1512, a cluster 1509 and a source domain 1507. Thus, a cluster associated with a source domain can only be referenced from the same sandbox.

An edge 1513 may associate a node 1510 in one source domain 1507 with the central node 1510 of a cluster 1509 associated with any global domain 1501. Thus, a cluster associated with a global domain can be referenced from any cluster.

Since there may be no edges associating a node outside a sandbox to a node in said sandbox, removing said sandbox, including all its clusters, has no effect on the rest of the storage.

In one embodiment, a source 1505 may create a cluster state, associated with said source, and assign it as the trunk cluster state of a cluster branch belonging to cluster associated with a source domain associated with another source. Thus, multiple sources, e.g. users, may collaboratively edit the same cluster.

In one embodiment, any access to clusters, including creating clusters and associating clusters with new cluster states, may require source privileges, using an access control system.

In this description, global domains, packages, types, properties, sources, sandboxes, sandbox domains and branches are describes as separate categories of components. In embodiments of the invention, any number of these components may be clusters.

A negative aspect of this is an increased complexity, including a possibility of direct or indirect circular references. For instance, a cluster representing a source may be associated with a cluster state, whose creation source is said source cluster. Also, said source cluster may be associated with a source domain, which may be associated with a sandbox and said source cluster. This may create a problem with the order of component creation.

A positive aspect of this is that you can dynamically attach information to the components, using edges with properties, e.g. adding user information, such as username, personal details and pictures to a source cluster.

In the preferred embodiment of the invention, sources are clusters, while all other components listed above are separate component categories.

In the preferred embodiment, domains, sources, branches, packages, types and properties may be identified using identifiers. Clusters may be identified using identifiers and integers. This implies that most information about a subset of the storage model, e.g. all clusters of one sandbox, may be encoded as a text file. Some values, e.g. file content, may be excluded. Said encoded subset may be stored and/or shared. Said encoded subset may also be parsed and merged with another storage. Embodiments of the invention may be used for merging two sets of clusters, e.g. by for each cluster in one set determining if its trunk cluster state is more recently created than the trunk cluster state of the corresponding cluster in the other set.

In the preferred embodiment, the components of the composition model are closely related to components of the storage method. Composition components, e.g. sections, patterns and parts, are stored as clusters. Intentions are stored as properties. Relations between components are stored using edges or structured values. Event lists are stored as structured values.

In the preferred environment, the invention initiates a process that periodically and automatically stores modified composition model components in the storage.

The storage method is part of the present invention. The storage method enables incremental updates of small clusters of information, instead of storing a complete composition model every time it is edited. The storage method also enables restoration of old versions of information. The storage method also enables switching between multiple, overlapping sets of information, using branches. All these features are valuable in the exploratory environment of creative composing, especially in an operating environment with limited resources, e.g. a mobile computer or a tablet computer.

Other embodiments may use other methods for storing the composition model.

In other embodiments, the storage method may be used for other purposes than for storing composition models.

Figure 16:
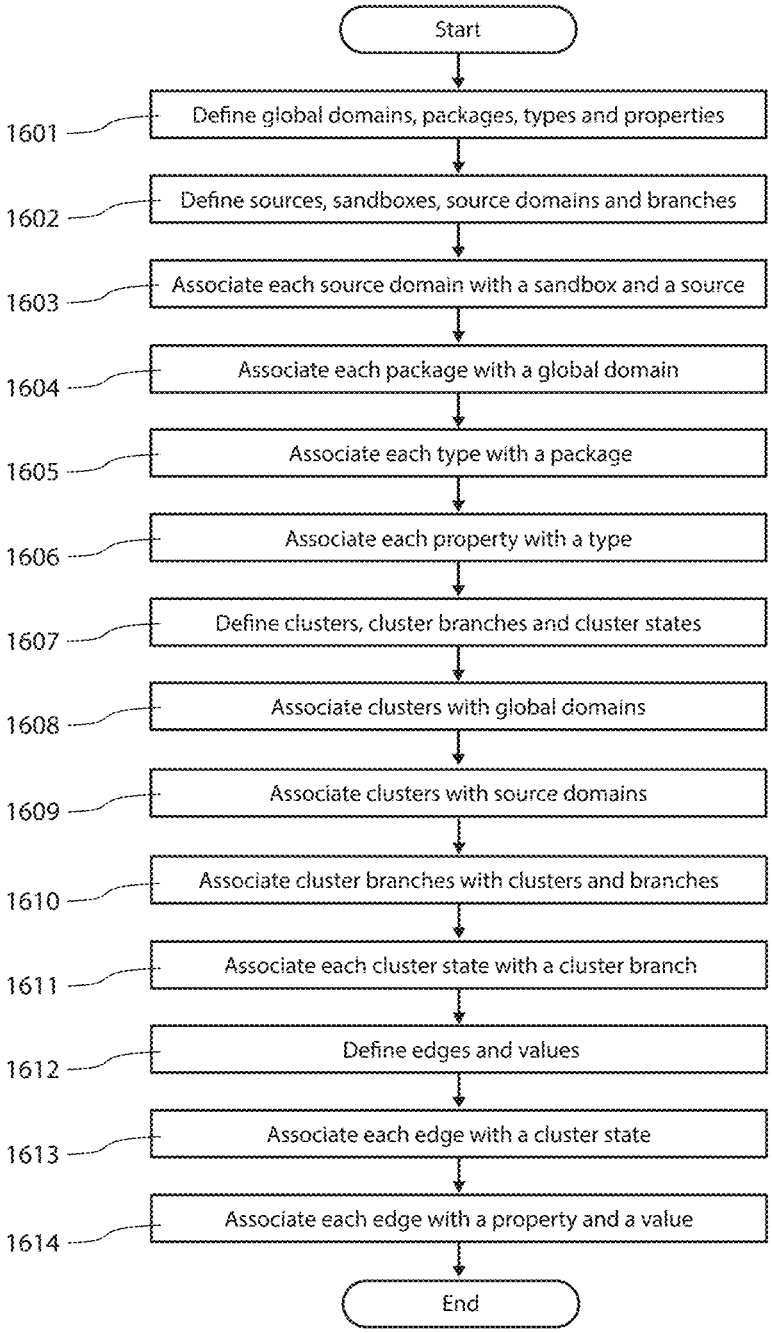
FIG. 16 is an exemplary flow chart illustrating a data organization method.

FIG. 16 shows an exemplary flow chart illustrating one embodiment of the storage method.

Define global domains, packages, types and properties 1601

Define sources, sandboxes, source domains and branches 1602

Associate each source domain with a sandbox and a source 1603

Associate each package with a global domain 1604

Associate each type with a package 1605

Associate each property with a type 1606

Define clusters, cluster branches and cluster states 1607

Associate each cluster with a global domain 1608 or a source domain 1609

Associate each cluster branch with a cluster and a branch 1610

Associate each cluster state with a cluster branch 1611

Define edges and values 1612

Associate each edge with a cluster state 1613

Associate each edge with a property and a value 1614

The order of these definitions and associations is not important. Some steps in the list of steps may be performed multiple times.

The preferred embodiment of the invention may be used for collecting clusters with a provided set of property values.

Figure 17:
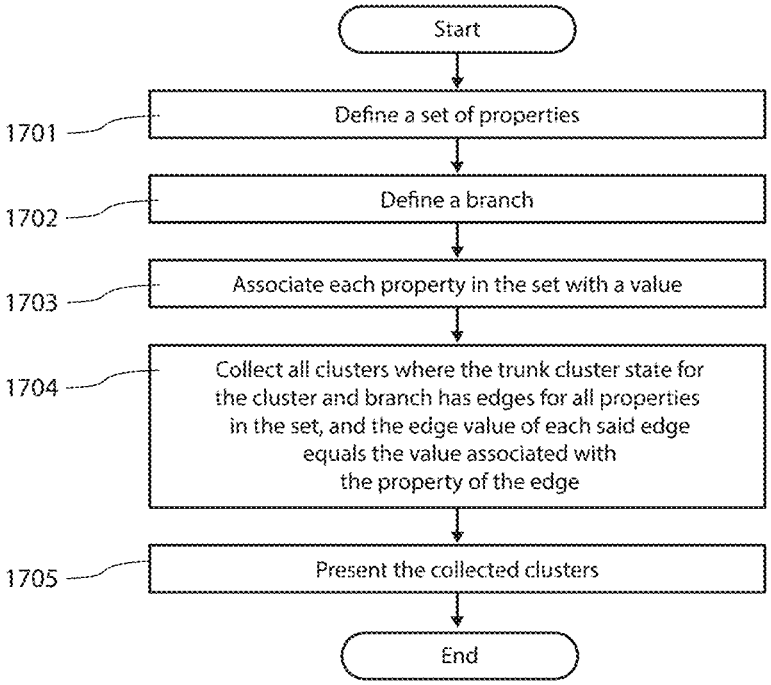
FIG. 17 is an exemplary flow chart illustrating a cluster retrieval method.

FIG. 17 shows an exemplary flow chart illustrating the collection of clusters.

Define a set of properties 1701

Define a branch 1702

Associate each property in the set of properties with a property value 1703

Collect all clusters such that for each property in the set of properties, the trunk cluster state of said cluster and the defined branch is associated with an edge, wherein the edge is associated with said property and the edge value of said edge equals the property value associated with the property 1704.

Present the collected clusters 1705.

FIG. 18 illustrates an exemplary user interface for a user to view cluster states of a sandbox, wherein the sandbox contains all information about one composition.

An element in the list of present and past cluster states 1801 may be selected. The selected cluster state can be restored 1802, which modifies only the cluster associated with the selected cluster state. The trunk cluster state preceding the selected cluster state can be restored, i.e. the selected cluster state can be undone 1803. All cluster states in the sandbox created after the selected state can be undone, i.e. restore the sandbox to the state it had when the selected cluster state was trunk cluster state 1804. FIG. 18 illustrates how tightly integrated the storage method is with the rest of the invention.

While aspects of the invention have been described in relation to musical concepts, embodiments of the invention may generally be applied to any concepts that organizes ordered changes, e.g. video, audio, film, scenography, stage lighting and equipment control.

This detailed description uses various terms, e.g. from graph theory. Modifications and variations of the terms are possible without departing from the scope of aspects of the invention as defined in the appended claims.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein.

For example, it is contemplated that executing or performing a particular operation before, contemporaneously with, or after another operation is within the scope of aspects of the invention.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

What is claimed is:

1. A computer-implemented method of modeling compositions, said method comprising:

(a) defining at least one part, said parts corresponding to separate actors in the composition;

(b) defining at least one section, said sections corresponding to divisions of the composition;

(c) defining at least one pattern;

(d) defining at least one intention, said intentions corresponding to categories of change in the composition;

(e) defining at least one event channel, corresponding to a category of change in a defined section;

(f) defining at least one event channel, corresponding to a category of change in a defined pattern;

(g) associating each of the at least one section with at least one event channel;

(h) associating each of the at least one pattern with at least one event channel;

(i) associating each of the at least one part with at least one event channel;

(j) associating each of the at least one event channel with one of the at least one intention;

(k) defining at least one event, said events corresponding to change from a value to a new value in the composition, wherein each of said events contains a representation of the new value;

(l) associating each of the at least one event with a defined event channel;

(m) storing each of the at least one part on computer-readable media;

(n) storing each of the at least one section on computer-readable media;

(o) storing each of the at least one pattern on computer-readable media;

(p) storing each of the at least one event channel on computer-readable media;

(q) storing each of the at least one event on computer-readable media;

(r) producing data representative of the composition model; and (s) presenting the produced data to an operator.

2. The method of claim 1, wherein producing data comprises producing audio data representative of the composition model.

3. The method of claim 1, wherein producing data comprises producing at least one graphical image representative of the composition model.

4. The method of claim 1, further comprising:

(a) defining at least one beat;

(b) associating each of the at least one beat with an event; and (c) storing each of the at least one beat on a storage medium.

5. The method of claim 4, further comprising:

(a) producing at least one temporary note event; and (b) associating the produced at least one note event with an event channel.

6. The method of claim 5, wherein producing temporary note events for a provided part and a provided section at a provided beat comprises:

(a) for each pattern of the at least one pattern, calculating the total pattern weight, said calculation comprising:

i. selecting said pattern;

ii. calculating a pattern beat corresponding to the provided beat;

iii. collecting pattern event channels associated with the selected pattern;

iv. for each pattern event channel of the collected pattern event channels, calculating the pattern event channel weight, said calculation comprising:

A. selecting said pattern event channel;

B. retrieving the section event channel associated with the provided section, the part associated with the selected pattern event channel, and the intention associated with the selected pattern event channel;

C. retrieving a section event, associated with the provided beat, from the retrieved section event channel;

D. retrieving a pattern event, associated with the calculated pattern beat, from the selected pattern event channel; and E. calculating the pattern event channel weight of the selected pattern event channel, based on the retrieved section event and the retrieved pattern event; and v. calculating the total pattern weight of the selected pattern, based on the pattern event channel weights of the pattern event channels associated with the selected pattern;

(b) selecting a pattern, based on the total pattern weight of each of the at least one patterns; and (c) producing the note events of the selected pattern associated with the pattern beat calculated for the selected pattern.

7. The method of claim 6, wherein producing a note event for a provided part and a provided section at a provided beat further comprises:

(a) retrieving a section chord event associated with the provided section, the chord intention and provided beat;

(b) retrieving a pattern chord event associated with the selected pattern, the chord intention and the pattern beat calculated for the selected pattern; and (c) altering the pitch of the produced note events, based on the retrieved section chord event and the retrieved pattern chord event.

8. The method of claim 1, further comprising:

(a) defining at least one piece of equipment, said pieces of equipment corresponding to actors in the composition which do not correspond to any part;

(b) associating each of the at least one piece of equipment with at least one event channel; and (c) storing each of the at least one piece of equipment on a storage medium.

* * * * *